United States Patent [19]

Gilbertson

[11] Patent Number: 4,634,839

[45] Date of Patent: Jan. 6, 1987

[54] FILTERED WARM AIR DRYING DEVICE

[76] Inventor: John E. Gilbertson, 2200 Ashworth Rd., West Des Moines, Iowa 50265

[21] Appl. No.: 689,457

[22] Filed: Jan. 7, 1985

[51] Int. Cl.[4] ..... H05B 1/00; A45D 20/08; F24H 3/04

[52] U.S. Cl. ..... 219/373; 34/97; 34/243 R; 219/360; 219/370; 219/380

[58] Field of Search ..... 219/366–370, 219/373, 379, 380, 364; 34/96–101, 243 R; 239/133, 136

[56] References Cited

U.S. PATENT DOCUMENTS

| | | | |
|---|---|---|---|
| 1,869,737 | 8/1932 | Breuer | 219/373 |
| 2,096,023 | 10/1937 | Albertson | 219/380 |
| 2,209,054 | 7/1940 | Doud et al. | 34/243 R |
| 2,420,732 | 5/1947 | Bichsel et al. | 219/374 X |
| 2,808,124 | 10/1957 | Attwood | 219/360 |
| 3,837,581 | 9/1974 | Orsoff | 219/373 X |
| 3,857,016 | 12/1974 | Meyer et al. | 219/373 X |
| 3,943,329 | 3/1976 | Hlavac | 219/373 X |
| 4,196,343 | 4/1980 | Han | 219/364 |
| 4,349,725 | 9/1982 | Sheridan | 219/373 |
| 4,538,362 | 9/1985 | Andis | 219/370 X |

FOREIGN PATENT DOCUMENTS

| | | | |
|---|---|---|---|
| 1296619 | 5/1962 | France | 34/97 |
| 110060 | 8/1979 | Japan | 219/373 |
| 429261 | 5/1935 | United Kingdom | 219/360 |

*Primary Examiner*—A. Bartis

*Attorney, Agent, or Firm*—Zarley, McKee, Thomte, Voorhees & Sease

[57] ABSTRACT

A forced air drying device for supplying filtered warm air for drying small areas, such as, for example, in dentistry or orthodontics, for drying of the teeth or gums prior to work thereon, includes a hand held forced air unit, such as a hair dryer, provided with a motor driven fan directing a stream of air over an electric heating element and through an outlet opening toward the area to be dried. A detachable nozzle has a first end mounted over the outlet opening and a second end with a reduced cross-sectional area for directing a concentrated stream of heated air to the area to be dried. The nozzle is provided with exhaust vents between the first and second ends thereof to prevent overheating of the motor due to a build-up of pressure resulting from the reduced cross-sectional area of the nozzle second end. An air deflector is provided adjacent each exhaust vent for directing escaping air away from the second and end of the nozzle. A removable air filter is provided for removing microscopic impurities from the air prior to projection of the air from the second end of the nozzle. Controls are provided for adjusting the temperature as well as the volume of air projected from the nozzle second end.

5 Claims, 7 Drawing Figures

FILTERED WARM AIR DRYING DEVICE

BACKGROUND OF THE INVENTION

Forced air drying devices are well known, such as hand held hair dryers and the like. Such conventional air drying devices typically heat ambient air and force it in a general direction toward an enlarged area to be dried. However, such conventional dryers are not useful where the area to be dried is relatively small, such as in the field of dentistry, wherein a tooth or teeth are to be dried prior to work thereon. Also, these conventional air dryers are not sanitary for drying various infection prone areas of the body, such as the teeth, gums and mouth, due to the various impurities in the air.

Therefore, it is a primary objective of the present invention to provide an air drying device for use in drying specific small areas.

A further objective of the present invention is the provision of an air drying device which filters the air prior to use in drying an area.

Another objective of the present invention is the provision of a filtered warm air drying device which is simple to operate, economical to manufacture, and durable in use.

SUMMARY OF THE INVENTION

The filtered warm air drying device of the present invention comprises a housing having air inlet and air outlet ends, a plurality of rotatable fan blades positioned within the housing for drawing air through the inlet opening and projecting the air out the outlet opening, a motor operatively connected to the fan blades for imparting rotation thereto, and a heating element within the housing for warming the air drawn into the device prior to projection therefrom. The device further comprises a removable air filter mounted in the housing for cleansing the air prior to projection from the device and a detachable nozzle mounted over the air outlet opening for directing the air towards a small area to be dried. Control means are also provided for adjusting the temperature of the heating elements, and for controlling the speed of the fan blades such that the volume of air projected from the device is adjustable.

DETAILED DESCRIPTION OF THE INVENTION

Figure 2:
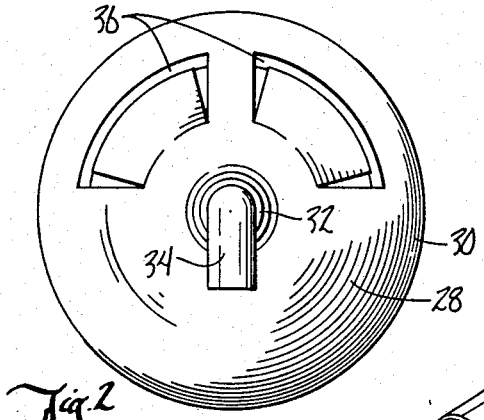
FIG. 2 is a front elevational view of the device.
Figure 1:
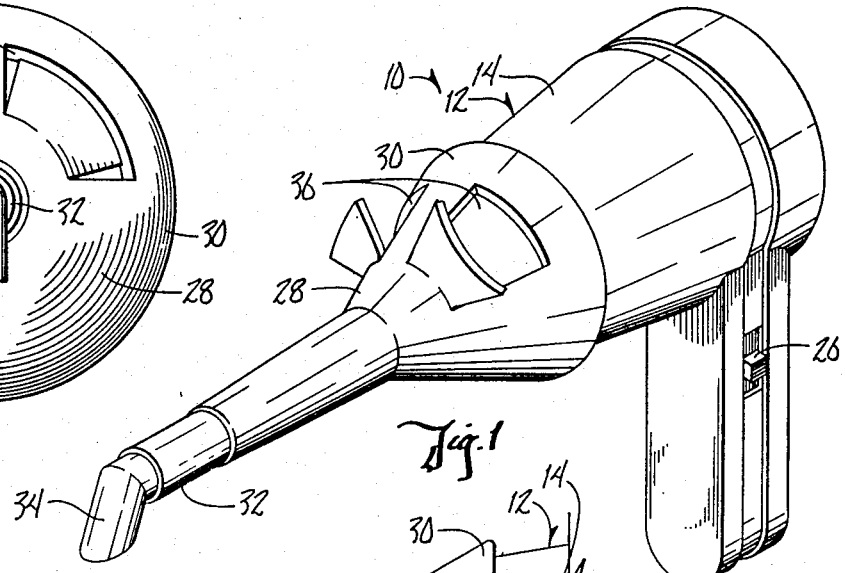
FIG. 1 is a perspective view of the air drying device of the present invention.
Figure 3:
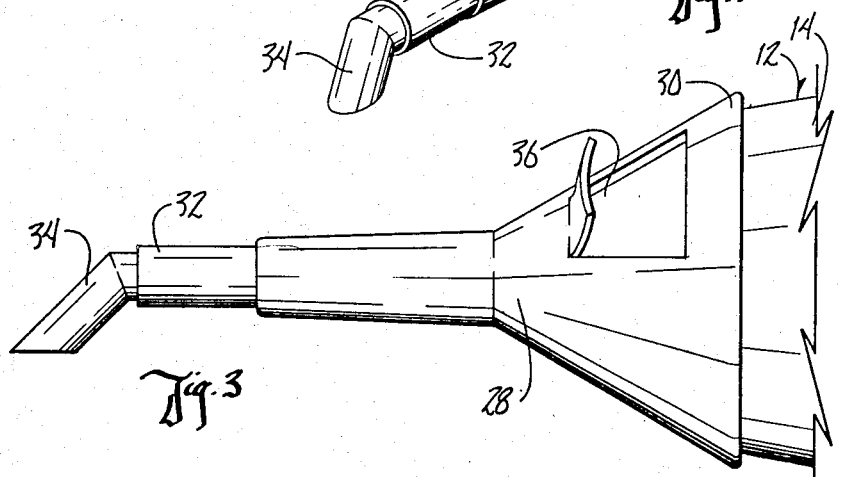
FIG. 3 is a partial side elevational view of the device.
Figure 4:
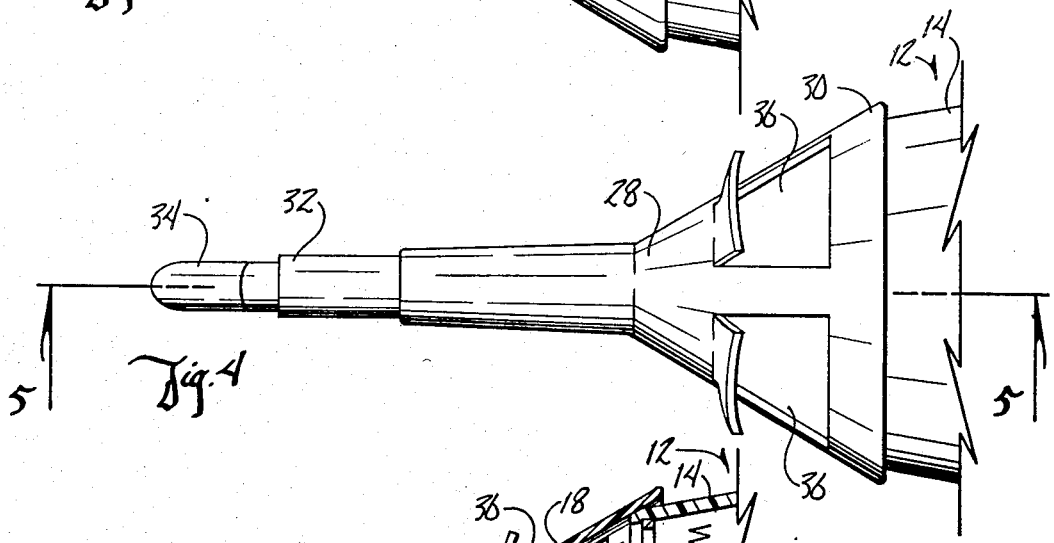
FIG. 4 is a partial top plan view of the device.
Figure 5:
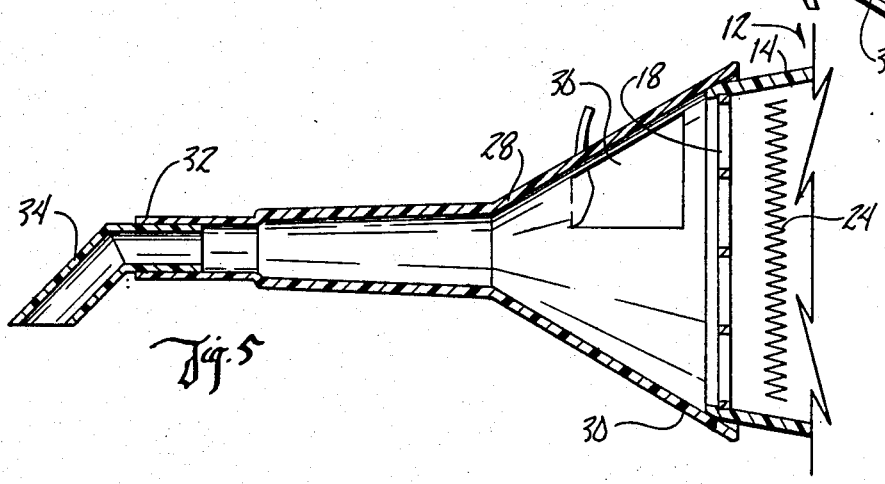
FIG. 5 is a partial sectional view taken along lines 5—5 of FIG. 4.

The filtered warm air drying device of the present invention is generally designated in the drawings by the reference numeral 10. Device 10 includes a conventional forced air drying unit 12, such as a hair dryer. Dryer unit 12 includes a housing 14 having a handle 15, an air inlet opening 16 and an air outlet opening 18. Mounted within housing 14 is a plurality of rotatable fan blades 20 for drawing air through inlet opening 16 and projecting air out outlet opening 18 toward an enlarged area to be dried. A motor 22 is operatively connected to fan blades 20 for imparting rotation thereto, and is coventionally connected to a standard electrical outlet (not shown). A heating element 24 is fixed within housing 14 for warming the air drawn into device 10 prior to projection therefrom. Control means 26 is also provided for controlling the speed of motor 22 and blades 20 such that the volume of air projected from device 10 is adjustable and for controlling the temperature of heating elements 24 such that the temperature of the air is adjustable.

A tapered nozzle 28 is mounted on dryer unit 12 over outlet opening 18 thereof. Nozzle 28 has a large rearward end 30 adapted to fit over outlet opening 18 and a spaced apart smaller forward end 32. This construction of nozzle 28 permits the air which is normally projected from outlet opening 18 toward an enlarged area to be directed to a specific smaller area to be dried. A second nozzle 34 may be mounted on forward end 32 of primary nozzle 28 for more precise projection of the air for specific drying purposes. Nozzle 34 may be angularly disposed with respect to nozzle 28, as shown in the drawings, or may be constructed of flexible material so as to provide easier access to remote areas to be dried. Exhaust vents 36 are provided in nozzle 28 adjacent rearward end 30 thereof to prevent overheating of motor 22 due to the build-up of pressure resulting from the change in area from rearward end 30 to forward end 32 of nozzle 28. Each exhaust vent 36 is provided with an air deflector 36A for directing the air escaping through the vent away from the forward end 32 of the nozzle.

Figure 6:
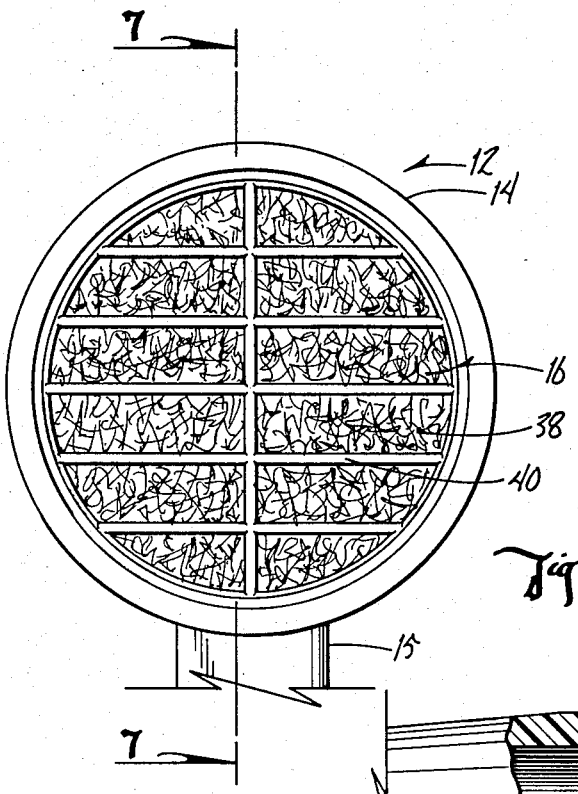
FIG. 6 is a rear elevational view of the device.
Figure 7:
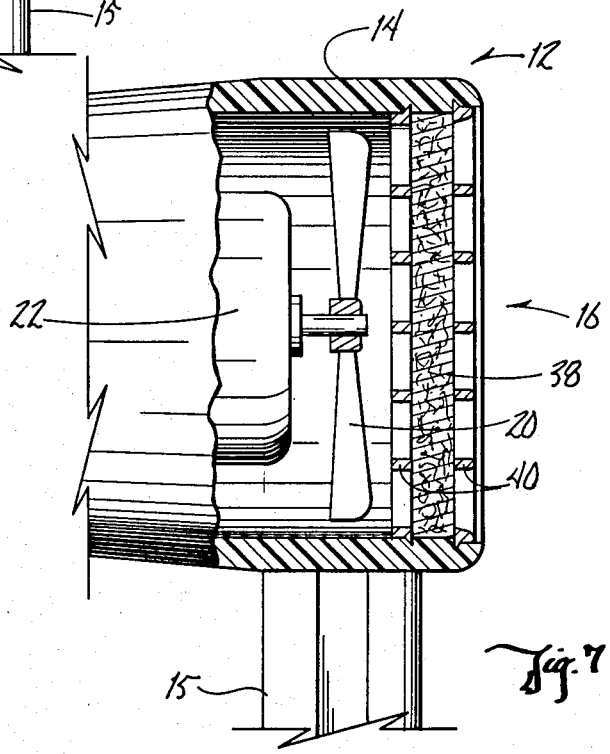
FIG. 7 is a partial sectional view of the device taken along line 7—7 of FIG. 6.

As seen in FIGS. 6 and 7, an air filter 38 is mounted over inlet opening 16 and is held in place by a filter bracket 40. While filter 38 is preferably mounted over inlet opening 16, it is understood that filter 38 can be mounted anywhere within device 10 so as to filter the air prior to projection therefrom. Filter 38 removes impurities from the air which may cause infection or allergic reactions in areas of the human body to be dried. Filter 38 also permits sterilized objects to be dried without contamination.

The filtered warm air drying device of the present invention is useful in many environments wherein specific small areas of physical objects and of the human body are to be dried. For example, in dentistry and orthodontia, it is often necessary to dry the teeth and gums prior to work thereon.

Thus, it can be seen that the filtered warm air drying device of the present invention provides directionalized flow of filtered warm air to a specific small area to be dried and accomplishes at least all of the stated objectives.

What is claimed is:

1. An air drying device comprising:

a housing having air inlet and air outlet openings;

a plurality of rotatable fan blades within said housing for drawing air through said inlet opening and projecting air out said outlet opening toward an enlarged area to be dried;

motor means operatively connected to said fan blades for rotating said blades;

a detachable nozzle having a first open end mounted over said air outlet opening and having a second open end with a cross-sectional area less than that of said first end for directing air toward a reduced area to be dried;

said nozzle having an exhaust vent between said first and second ends for escape of air thereby preventing overheating of said motor means;

said nozzle further including an air deflector adjacent said exhaust vent for directing the escaping air away from said second end of said nozzle; and a removable air filter means for removing microscopic impurities from the air prior to projection of the air from said second end of said nozzle.

2. The device of claim 1 wherein said filter is mounted over said inlet opening.

3. The device of claim 1 further comprising heating means within said housing for warming the air drawn into said device prior to projection therefrom.

4. The device of claim 3 further comprising heat control means for adjusting the temperature to which the air is warmed.

5. The device of claim 1 further comprising control means operatively connected to said motor means for controlling the speed of rotation of said fan blades such that the volume of air projected from said device is adjustable.

* * * * *